United States Patent [19]

Suzuki et al.

[11] Patent Number: 4,617,979

[45] Date of Patent: Oct. 21, 1986

[54] METHOD FOR MANUFACTURE OF CAST ARTICLES OF FIBER-REINFORCED ALUMINUM COMPOSITE

[75] Inventors: Nobuyuki Suzuki, Shizuoka; Kenichi Tanaka, Tokyo; Masanao Yamanashi, Shimizu, all of Japan

[73] Assignees: Nikkei Kako Kabushiki Kaisha; Nippon Light Metal Company Limited, both of Tokyo, Japan

[21] Appl. No.: 755,148

[22] Filed: Jul. 15, 1985

[30] Foreign Application Priority Data

Jul. 19, 1984 [JP] Japan ..... 59-148646
May 27, 1985 [JP] Japan ..... 60-112082

[51] Int. Cl.[4] ..... B22D 23/00; B22D 19/14
[52] U.S. Cl. ..... 164/97; 164/461
[58] Field of Search ..... 164/97, 461, 900

[56] References Cited

U.S. PATENT DOCUMENTS 3,110,939 11/1963 Lockwood ..... 164/97
4,232,091 11/1980 Grimshaw et al. ..... 164/97 X
4,340,109 7/1982 Roddy ..... 164/97
4,473,103 9/1984 Kenney et al. ..... 164/97
4,548,253 10/1985 Funatani et al. ..... 164/97 X
4,572,270 2/1986 Funatani et al. ..... 164/97

FOREIGN PATENT DOCUMENTS 57-139464 8/1982 Japan ..... 164/97
57-152364 9/1982 Japan ..... 164/900

*Primary Examiner*—Nicholas P. Godici
*Assistant Examiner*—J. Reed Batten, Jr.
*Attorney, Agent, or Firm*—William J. Daniel

[57] ABSTRACT

Cast articles of fiber-reinforced aluminum composite excellent in plastic moldability and capable of forming drawn products featuring good mechanical properties, particularly wear resistance, are manufactured by mixing under pressure an inorganic fibrous material prepared in advance in the form of a multiplicity of doughy pills, with an aluminum melt thereby producing a mixed melt and casting this mixed melt in a desired shape.

7 Claims, No Drawings

METHOD FOR MANUFACTURE OF CAST ARTICLES OF FIBER-REINFORCED ALUMINUM COMPOSITE

FIELD OF THE INVENTION

This invention relates to a method for the manufacture of cast articles having an inorganic fibrous reinforcement material dispersed in an aluminum or aluminum alloy (hereinafter referred to collectively as "aluminum") matrix.

DESCRIPTION OF PRIOR ART

Composite materials having short inorganic reinforcement fibers of carbon, silicon carbide, alumina and the like dispersed in an aluminum matrix enjoy outstanding mechanical strength and wear resistance in addition to the merit of light weight inherent in aluminum. In recent years, extensive attempts have been made to use such composite materials in various machine parts.

As a means of obtaining a cast article of aluminum containing such short inorganic fibers, a method comprising the steps of placing such short fibers in a mold and mixing the short fibers under pressure with aluminum melt has been known to the art. In articles obtained by this method, the fibers contained therein are liable to be unevenly distributed locally. It has been difficult, therefore, to obtain by this method a composite having reinforcing fibers uniformly dispersed therein. An attempt is being made, therefore, to develop a procedure comprising the steps of obtaining a solid mass by mixing an aluminum melt under pressure with a fibrous material, remelting the solid mass either alone or in a form increased with added aluminum melt, and casting the resulting melt in a mold of desired shape. Since the melt so produced during the course of this procedure contains the fibrous material irregularly in a large amount, it exhibits an extremely inferior flowing property and is cast in a mold of complicated shape with great difficulty. The cast articles of the composite which can be obtained at all in this way, therefore, are subject to restriction as to shape.

The inventors have previously proposed a method for the manufacture of cast composite articles which comprises the steps of obtaining a solid mass by mixing short inorganic fibers under pressure with aluminum melt, finely comminuting the solid mass into fine particles, melting these fine particles into secondarily added aluminum melt, and casting the resultant melt in a mold of desired shape (Japanese Patent Application No. SHO 59(1984)-65,690).

The aforementioned method of Japanese Patent Application No. SHO 59(1984)-65,690 preliminarily comminutes the solid mass of short inorganic fibers and aluminum into fine particles and subsequently remelts the fine particles into the secondarily added aluminum melt with a view to improving the flow of the fiber-containing melt and facilitating the recasting of the composite solid mass. Even this method has suffered from the following disadvantage. Since the composite solid mass obtained by mixing the short inorganic fibers under pressure with the aluminum melt solidified in a state powerfully reinforced with a large amount of the fibers in irregularly dispersed condition, the comminution of this solid mass presents unusual difficulty and the production of the finely comminuted particles in large amounts on a commercial scale takes a considerably long time.

SUMMARY OF THE INVENTION

The inventors continued a further study in search of a solution for the aforementioned problem suffered by the conventional method. They have consequently found that short inorganic fibers intended as reinforcement, when stirred in a container, become intertwined and agglomerated into numerous doughy pills, that a melt obtained by mixing such doughy pills with molten aluminum exhibits a much better flowing property than the conventional melt which contained a non-uniform dispersion of fibers and casts easily in a mold of virtually any desired shape, and that the cast article consequently produced possesses much better plastic moldability than the conventional cast article, and is easily transformed by extrusion or rolling into a drawn composite material.

The present invention is the result of this discovery.

To be specific, this invention concerns a method for the manufacture of cast articles of fiber-reinforced aluminum composite by the steps of preparing short inorganic reinforcement fibers in the form of a multiplicity of doughy pills, mixing the doughy pills of fibers with aluminum melt to give a fiber-containing mixed melt, and casting this mixed melt in a desired shape either immediately or after solidification and remelting.

Other objects and characteristic features of the present invention will become apparent to those skilled in the art from the following detailed description of a preferred embodiment of the invention.

DESCRIPTION OF A PREFERRED EMBODIMENT

Now, the method of this invention will be described more specifically below.

The method of this invention begins with the step of preparing short inorganic reinforcement fibers in the form of a multiplicity of doughy pills. The short inorganic fibers to be used as the raw material for reinforcement may be fibers of carbon, silicon carbide, alumina, or any other suitable substance. The agglomeration of these short inorganic fibers can be achieved by placing the fibers in a mixing container provided with stirring blades, a rotary mixer, or a V-shaped mixer and gradually stirring them therein. When the fibers are placed in a small mixing container provided with stirring blades and stirred therein for 5 to 30 minutes, for example, the fibers in the container are properly chopped and intertwined and transformed into a multiplicity of doughy pills roughly measuring 0.1 to 3 mm in diameter, though more or less variable with the type of substance used for the fibers.

Although the agglomeration of the above-mentioned fibers can be achieved by stirring these fibers in the dried state, in order to efficiently agglomerate the fibers into doughy pills with a minimum amount of short broken fibers resulting from the stirring, the agglomeration is preferably achieved by stirring the fibers while moistening the same by sprinkling with a small amount of water. The agglomeration can further be achieved by stirring a slurry of the fibers at a concentration of about 30% and formed by mixing with water or a volatile vehicle such as a lower alcohol.

As the fibers to be used for the agglomeration, commercially available short fibers containing relatively short fibers having the length of, for example, several centimeters can be used. When stirring fibers of this type, they become properly chopped or broken as need be and intertwined and transformed into the desired doughy pills. With fibers having a length of 1 cm or less, the time for the agglomeration of the fibers can be shortened and doughy pills of well regulated shape can efficiently be obtained. Therefore, fibers, in a length selected in advance in the range of 1 to 10 mm, are preferably used.

In the next step, the doughy pills of fibers prepared as described above are mixed with aluminum melt which acts as a matrix. The material for the aluminum melt to be used as the matrix herein may be aluminum of the purity of ordinary industrial grade of AA1000 series or the purity of casting grade of AA4000 series or an aluminum alloy of a composition suitable for the purpose for which the cast article is used. Otherwise, it may be an aluminum alloy of the composition of hot drawing grade of AA6000 series or AA7000 series. The mixture of the doughy pills of fibers with the aluminum melt is desired to be carried out under the application of pressure to the melt in order for the aluminum melt to interpermeate thoroughly the pores in the interstices of the doughy fiber pills. The pressurization of this mixture can be effected by placing the doughy pills in a container and forcibly introducing the aluminum melt into the container with the aid of a high-power press. Alternatively, by creating the mixture under pressure generated by a centrifugal machine, the aluminum melt is able to penetrate the pores and interstices of the doughy fiber pills to a greater depth more easily and more thoroughly. In mixtures of the doughy fiber pills and aluminum melt obtained as described above, the content of fibers generally falls in the range of 5 to 20% by volume. This content can be increased to the level of 30% by volume by first preparing the doughy fiber pills in a compressed state and then mixing the aluminum melt with the doughy pills under continued application of pressure. When the mixed melt is to be prepared so as to contain the doughy fiber pills in a high bulk density as described above, it is advantageous to have the doughy fiber pills sprinkled in advance with a small amount of a powdered inorganic substance, such as aluminum oxide finely comminuted to a particle diameter of not more than several microns, which is sparingly reactive with aluminum melt, because the inorganic powder prevents the doughy pills of fibers from mutually adhering and enables them to be evenly dispersed in the aluminum melt when the composite melt is solidified immediately after its preparation and later remelted. The addition of the powdered inorganic substance also proves advantageous in facilitating the crushing of the composite solid mass consisting of the doughy fiber pills and aluminum. The powdered inorganic substance to be used for this purpose may be finely comminuted titanium dioxide or silicon nitride in addition to aluminum oxide. The amount of the powdered inorganic substance to be added relative to the doughy pills of fibers should fall roughly in the range of 0.5 to 20% and desirably not to exceed 10%, by weight. Addition of an excess amount of powdered inorganic substance is to be avoided because this excess acts to impede the wetting of the doughy pills of fibers by the aluminum melt and prevents the aluminum melt from readily penetrating the pores of the doughy pills during the course of their mixture with the aluminum melt.

The addition of the powdered inorganic substance to the doughy fiber pills can be achieved by any of the following steps: adding the powdered inorganic substance while stirring the doughy pills so as to have the pills sprinkled with the powdered inorganic substance; stirring the doughy pills while spraying them with a dispersion of the powdered inorganic substance in water or a volatile vehicle such as a lower alcohol; immersing the doughy pills in a suspension of the powdered inorganic substance and then filtering them; or any other suitable technique. The addition of the powdered inorganic substance to the doughy fiber pills can further be achieved simultaneously with the agglomeration of the fibers into the doughy pills. For example, in a wet agglomeration wherein the fibers are suspended in water or volatile vehicle to form a slurry and the slurried fibers are stirred to agglomerate them into the doughy pills, if a proper amount of the powdered inorganic substance is dispersed in advance in the water or volatile vehicle, one can obtain the doughy fibers pills sprinkled uniformly with the powdered inorganic substance. The resultant doughy fiber pills will be dried, if necessary, and then mixed with the aluminum melt under the application of pressure.

In a subsequent step, the mixed or composite melt obtained by the mixture of the doughy fiber pills with the aluminum melt as described above can be cast in a mold of desired shape. This casting may be effected by simply allowing the original mixed melt to flow directly into the mold. Preferably, however, it is accomplished by allowing the mixed melt to solidify, then remelting the composite solid mass by heating, and thereafter casting the melt in the mold for the purpose of facilitating the work of casting and ensuring the production of cast articles of uniform quality. The remelting of the composite solid mass can be effected by using an externally heating furnace. It can be carried out more efficiently by using a high-frequency or low-frequency induction furnace. The solid mass may be remelted directly without alteration. Optionally, it may be remelted after crushing into lumps or grains of suitable size. This crushing may be carried out by a crushing machine, a beating machine, or an impeller. During the course of the remelting of the solid mass, a suitable further amount of aluminum melt may be added as a secondary supply in order to adjust the content of fibers in the ultimate melt so as to suit the purpose for which the cast article is to be used.

The mixed melt formed of the doughy fiber pills and aluminum by the method of this invention as described above has short fibers disposed therein in the form of dough pills. As compared with the conventional melt which has a fibers irregularly contained therein in their original discrete state, the mixed melt of this invention exhibits a highly satisfactory flowing property and can be easily cast in any desired shape by gravity casting, continuous casting with water cooling, pressure casting, die casting, or some other convenient casting in the same way as the conventional casting of aluminum alloy melt.

The composite cast article obtained by the method of this invention described above has short inorganic fibers evenly contained as reinforcement in the form of doughy pills and possesses an outstanding wear resisting property and, therefore, can be used directly for machine parts. The cast article produced in the form of billets or slabs by the method of the present invention possesses a much higher plastic moldability than a conventional composite cast article having the same fibers irregularly contained therein and, therefore, can be hot extruded or rolled in the same way as any aluminum alloy material, to produce a bar-shaped or plate-shaped drawn material of aluminum reinforced with short inorganic fibers.

As described above, the present invention is directed to a method for the manufacture of a cast article of fiber-reinforced aluminum composite by the steps of preparing a multiplicity of doughy pills of short inorganic reinforcement fibers, mixing aluminum melt under pressure with the doughy pills, and casting the resultant mixed melt either immediately or after solidification and remelting. The mixed melt obtained by mixing the doughy pills of fibers under pressure with the aluminum melt possesses a much higher flowing property and casts far more easily than the conventional melt having short inorganic fibers dispersed in their original state in aluminum melts as used in the manufacture of composite cast articles. In accordance with the method of this invention, therefore, cast articles of more complicated shapes can be produced more easily than with the conventional method. Moreover, the cast articles obtained by the method of this invention possess a satisfactory plastic molding property and can be easily transformed by hot extrusion or rolling into a drawn material excelling in mechanical properties, particularly wear resistance.

Now, the present invention will be described more specifically below with reference to working examples.

EXAMPLE 1

An alloy of type AA2017 was used for the matrix and short alumina fibers ($3\mu$ in diameter$\times$1 cm in length) were used as short inorganic reinforcement fibers.

When 2 liters of the alumina fibers were placed in a container having an inner volume of 5 liters and provided with a stirrer and stirred therein for about 20 minutes, they were transformed into a multiplicity of doughy pills about 0.6 mm in diameter.

In a centrifugal container, 0.4 kg of the doughy fiber pills and 4 kg of the aluminum alloy (alloy of AA2017) melted in advance by heating were centrifugally mixed for about 15 minutes and then solidified.

In an electric furnace, 4.4 kg of the thus solidified mass, placed in a graphite crucible, was melted at 650° C. and thoroughly stirred, and cast in a mold to produce a billet 40 mm in diameter and 120 mm in length.

The billet-shaped cast article was subjected to hot extrusion molding (450° C.) and consequently transformed into a round bar 10 mm in diameter (designated Sample A).

EXAMPLE 2

Doughy pills of alumina fibers were prepared by following the procedure of Example 1. Then, 0.4 kg of the doughy pills and 10 g of finely comminuted aluminum oxide (produced by Degussa A.G. of West Germany and marketed under trademark designation of "Aluminium Oxide c") added thereto as powdered inorganic substance were thoroughly stirred so as to cover the doughy pills with the powder.

The doughy pills of fibers covered with the aforementioned aluminum oxide powder were placed in a centrifugal container and then centrifugally mixed with 3.5 kg of thermally molten aluminum alloy (alloy of AA2017) added thereto. The resultant mixture in its molten state was added to 3.5 kg of molten aluminum alloy (alloy of AA2017) prepared in advance and thoroughly stirred until well mixed. The resultant mixture was cast in a cylindrical mold to produce a billet-shaped cast article 40 mm in diameter and 120 mm in length.

The composite cast article so produced was hot extrusion molded (150° C.) to afford a round bar 10 mm in diameter (Sample B).

EXAMPLE 3

An alloy of type AA6061 was used as matrix and the same short alumina fibers as described in Example 1 were used as fibers.

The alumina fibers were stirred in the same way as in Example 1 to produce doughy pills of fibers having an average diameter of about 0.6 mm.

In a centrifugal container, 0.5 kg of the doughy pills of fibers obtained as described above were placed and 4 kg of thermally melted aluminum alloy (alloy of AA6061) was added by pouring. They were centrifugally mixed and the resultant mixture was allowed to solidify.

The solid mass consequently formed was remelted by heating at about 700° C., cast in the shape of a billet 40 mm in diameter and 120 mm in length by following the procedure of Example 1, and hot extrusion molded (550° C.) into a rough bar 10 mm in a diameter (Sample C).

EXAMPLE 4

A composite solid mass was prepared by following the procedure of Example 3. Then, 3.5 kg of this solid mass was remelted at about 700° C. The melt was added to 3.5 kg of aluminum alloy melt (alloy of AA6061) prepared in advance. The mixture was thoroughly stirred, cast in the form of a billet 40 mm in diameter and 120 mm in length.

The composite cast article thus obtained was hot extrusion molded (550° C.) into a round bar 10 mm in diameter (Sample D).

EXAMPLE 5

A mixture of 0.5 kg of doughy pills of fibers prepared by following the procedure of Example 1 and 20 g of the same finely comminuted aluminum oxide as used in Example 2 was placed in a centrifugal container and centrifugally mixed with 4 kg of thermally molten aluminum alloy (alloy of AA2017). The resultant melt was allowed to solidify. The resultant solid mass was crushed into grains 2 to 6 mm in diameter.

The composite grains mentioned above were heated to about 700° C. The resultant melt was placed in a cylindrical mold and pressed with a plunger to form a billet 50 mm in diameter and 120 mm in length. The billet was held in the container of an extruder and hot extrusion molded (500° C.) into a round bar 10 mm in diameter (Sample E).

EXAMPLE 6

Composite grains 2 to 6 mm in diameter were prepared by following the procedure of Example 5. Then 3.5 kg of the composite grains were thrown into 3.5 kg of aluminum alloy (alloy of AA2017) melted in advance at 750° C. They were gradually stirred until mixed. The resultant melt was cast in a cylindrical mold 40 mm in diameter and 140 mm in length to produce a billet.

The composite cast article consequently obtained was hot extrusion molded (450° C.) into a round bar 10 mm in diameter (Sample F).

EXAMPLE 7

Doughly pills of fibers were prepared by following the procedure of Example 1. Then, 0.4 kg of the doughy pills was placed in a centrifugal container and 4 kg of aluminum alloy melt (alloy of JIS-ADC12) was added thereto. They were centrifugally mixed. The resultant mixture was allowed to solidify. The solid mass was remelted at 680° C. The resultant melt was injection molded with a pressure die casting machine, 250 tons in capacity, to produce a flat plate 100 mm in length, 50 mm in width, and 5 mm in thickness. Owing to the injection molding, the doughy pills of fibers dispersed in the melt were disentangled into individual fibers and dispersed evenly within the aluminum matrix (Sample G).

The samples obtained in Examples 1-7 (i.e. Samples A, B, C, D, E, F, and G) were tested for mechanical properties. The results are shown in the following table.

TABLE

| Mechanical Property Tested | Sample A | B | C | D | E | F | G |
|---|---|---|---|---|---|---|---|
| Tensile strength at room temperature ($kg/mm^2$) | 56 | 49 | 42 | 36 | 54 | 46 | 28 |
| Elongation at room temperature (%) | 1.2 | 1.8 | 6.2 | 8.0 | 1.1 | 1.8 | 0.5 |
| Young's modulus at room temperature ($t/mm^2$) | 11.8 | 8.6 | 10.4 | 8.3 | 11.5 | 8.5 | 8.7 |
| Tensile strength at 250° C. ($kg/mm^2$) | 28 | 19 | 21 | 18 | 26 | 18 | — |
| Wear* ($mm^3$) | 0.10 | 0.14 | 0.15 | 0.21 | 0.10 | 0.13 | 0.04 |

*The numerical values in this row represent amounts of wear determined by the method of Ohgoshi (1.5 m/sec of speed, 66.6 m of distance and 21 kg of final load).

What is claimed is:

1. A method for the manufacture of cast articles of a fiber-reinforced aluminum composite, comprising the steps of mixing under pressure with an aluminum melt an inorganic fibrous reinforcement material prepared in advance in the form of a multiplicity of doughy pills thereby producing a composite melt and casting said composite melt in a desired shape either directly or after solidification and remelting.

2. The method of claim 1 wherein said doughy pills of fibrous material are formed by subjecting a mass of said fibrous material to stirring until the same agglomerates into said doughy pills.

3. The method of claim 1 wherein said composite melt is solidified, mechanically subdivided into particles, admixed with additional molten aluminum until a casting melt is formed and then casting said casting melt into a desired shape.

4. The method of claim 1 wherein said doughy pills of said fibrous material and said aluminum melt are mixed under such pressure as to force said aluminum melt into the interstices of said doughy pills.

5. The method of claim 1 wherein the amount of said fibrous material is in the range of about 5-30% by volume of the composite melt.

6. The method of claim 1 which includes the step of applying a powdered generally inert inorganic material to said doughy pills of fibrous material to coat the same prior to their admixture with said aluminum melt.

7. The method of claim 6 wherein the amount of said powdered inorganic material is up to about 20% by weight of said fibrous material.

* * * * *